United States Patent [19]

Fraser

[11] 4,161,857

[45] Jul. 24, 1979

[54] FREEZE DRYING CONTAINER WITH MANUAL STOPPERING

[75] Inventor: Douglas S. Fraser, New Paltz, N.Y.

[73] Assignee: FTS Systems, Inc., Stone Ridge, N.Y.

[21] Appl. No.: 905,427

[22] Filed: May 12, 1978

[51] Int. Cl.[2] ..... B65B 31/02

[52] U.S. Cl. ..... 53/97; 53/101; 53/328

[58] Field of Search ..... 53/86, 97, 99, 101, 53/102, 319, 328

[56] References Cited

U.S. PATENT DOCUMENTS

| | | | |
|---|---|---|---|
| 649,012 | 5/1900 | Tapscott | 53/102 |
| 2,447,240 | 8/1948 | Eisler | 53/101 |

*Primary Examiner*—Travis S. McGehee

*Attorney, Agent, or Firm*—Robert E. Wagner; Gerald T. Shekleton

[57] ABSTRACT

A manual stoppering container assembly having a central shaft which is threadedly secured to a handle on an upper portion and fixedly secured to a stoppering plate at a lower portion. The handle is rotatably secured in the cover plate for imparting reciprocal motion to the stoppering plate. The stoppering plate is guided by tracks in the container body. The cover plate is fluid-tightly mounted on a container body, so that the downward movement of the stoppering plate may force a plug into a sample vial while the container assembly is under vacuum.

9 Claims, 4 Drawing Figures

FREEZE DRYING CONTAINER WITH MANUAL STOPPERING

BACKGROUND OF THE INVENTION

This application relates to an apparatus for use in vacuum assemblies and, more particularly, to an apparatus for stoppering sample vials while under vacuum.

It is often desirable to retain samples of material in discrete containers under vacuum for storage. A plurality of these discrete containers may be placed under vacuum in, for example, a desiccator and stored in such manner. However, without elaborate mechanisms for stoppering the individual vials, such as may be found in freeze drying apparatus, particularly those disclosed in U.S. Pat. No. 3,448,556 and in the Freeze Dryer Stoppering Apparatus, Application Ser. No. 832,786, filed Sept. 12, 1977, samples stored under vacuum in an open vial can be cross-contaminated by an adjacent vial or by impurities in the system. The above art each teaches a means for stoppering a plurality of vials within a freeze drying apparatus by the upward movement of an entire shelf against the flat bottom surface of the shelf above. An alternative approach, using inflatable bellows to stopper the vials as taught in U.S. Pat. Nos. 3,795,986 and 3,022,619, is not entirely satisfactory, as the bellows are subject to aging, leakage and other undesirable effects. Each such apparatus is disadvantageous to the small or low-volume user of such freeze drying or vacuum methods, in that the elaborate construction is overly expensive for such work. In addition, those who routinely stopper reference samples of a material being dried in large quantities have little use for such apparatus of large capacity and expense.

A more simplified arrangement is taught in U.S. Pat. No. 3,292,342, in which sample vials may be stoppered under refrigeration and vacuum through the reciprocal action of a push rod connected to a push plate disposed above the vials. Since the cylindrical sleeve within which the push rod reciprocates is metal and extends inside the freeze drying chamber, while being exposed to the air outside the chamber, various potential problems arise through the condensation of moisture on the cylindrical sleeve. Reciprocation of the rod is difficult to control, as the friction caused by the tight fit of the push rod, which was necessary to maintain the vacuum, made it extremely difficult to stopper a plurality of sample vials simultaneously. In addition, the integral use of refrigeration with such stoppering means as taught by each of the above references, imposes a minimum size and cost limitation which denies the use of these assemblies to the low-volume user.

SUMMARY OF THE INVENTION

It is therefore an object of the subject invention to provide an improved inexpensive stoppering apparatus for use in vacuum systems.

Another object of the subject invention is an improved stoppering apparatus having a controlled means of stoppering sample vials while under vacuum.

A further object of the subject invention is a stoppering apparatus which is provided without integral refrigeration means, thereby making available an inexpensive vacuum stoppering means.

These and other objects are attained in accordance with the present invention wherein there is provided an improved vacuum container stoppering apparatus. This stoppering apparatus comprises a wide mouth flask open at one end and turned or otherwise rounded to provide a smooth upper lip on the open end, in a manner well known in the art, for the support of a cover assembly. The interior of the container has two or more tracks along which a stoppering plate may ride for reciprocal travel within the container. The stoppering plate is rigidly attached at its center to a shaft. The shaft may be threaded throughout its length and is threadedly engaged with a handle mounted in the cover assembly through a central opening. The cover assembly comprises a cover plate of clear material, and has a shoulder on its periphery which acts as a seat for a resilient sealing material, preferably an O-ring. The cover plate is of a size that, when placed over the mouth of the container, the O-ring is effectively retained between the cover plate and the mouth of the container, contacting both, thereby providing an effective seal when vacuum is applied. A port within the cover plate maintains access to an external source of vacuum for the container interior.

A handle, essentially an elongated hollow nut, is rotatably mounted in the central opening of the cover plate and sealed against leakage both at its upper end and at the juncture with the cover plate. The handle is internally threaded at its lower end for engaging the shaft, so that upon rotation of the handle the stoppering plate at the opposite end of the shaft will reciprocate, moving in a direction according to the rotation of the handle. With such an arrangement, the stoppering plate may be easily and controllably moved with a mechanical advantage not found in the prior art and in a desired direction without fear of loss of vacuum or an imperfect stoppering movement.

Vacuum is admitted to the interior of the container by connecting the cover port to a source of vacuum through a valve such as that taught in U.S. Pat. No. 3,945,607 to Fraser, wherein the stoppering container may be selectively opened and closed to the vacuum source or to ambient air pressure, as desired.

DETAILED DESCRIPTION OF THE DRAWINGS

Further objects of the invention, together with additional features contributing thereto and advantages accruing therefrom, will be apparent from the following description of one embodiment of the invention, when read in conjunction with the accompanying drawings, wherein.

Figure 1:
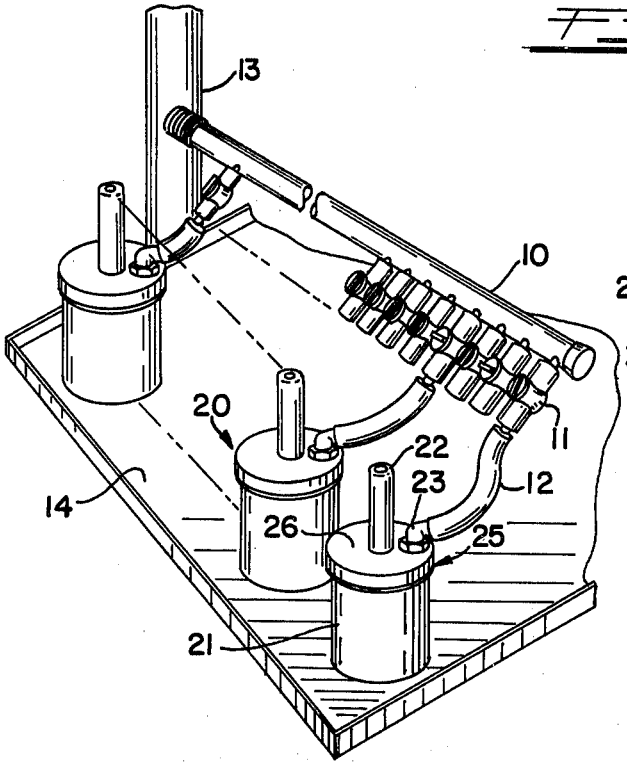
FIG. 1 is a perspective view showing a number of containers according to the subject invention attached to a source of vacuum.

Referring now to FIG. 1, there is shown a series of stoppering containers 20 in communication with a source of vacuum 13. Each stoppering container 20 includes a lower flask or container body portion 21, preferably of stainless steel to facilitate cleaning and resist breakage. A cover assembly 25, comprising a cover plate 26 and a handle 22, is secured in a fluid-tight manner to the top of the container 21 when under vacuum, as will be explained. The cover plate is preferably of a transparent material such as polycarbonate or polymethylpentene to allow viewing of the sample vials under vacuum. The handle is of high impact plastic, such as an acetal resin, sold under the trademark DELRIN®.

Connection to the vacuum source is made through elbow 23 and tubing 12 which, in turn, attaches to valve 11. The valve 11 preferably allows alternate opening and closing to the source of vacuum and access to the ambient air. This vacuum connection may be through a manifold such as shown at 10, which will allow connections for a desired number of vacuum connections to a plurality of the stoppering containers of the subject invention, as well as for other purposes. The manifold 10 is connected at one end to a source of vacuum 13.

Figure 2:
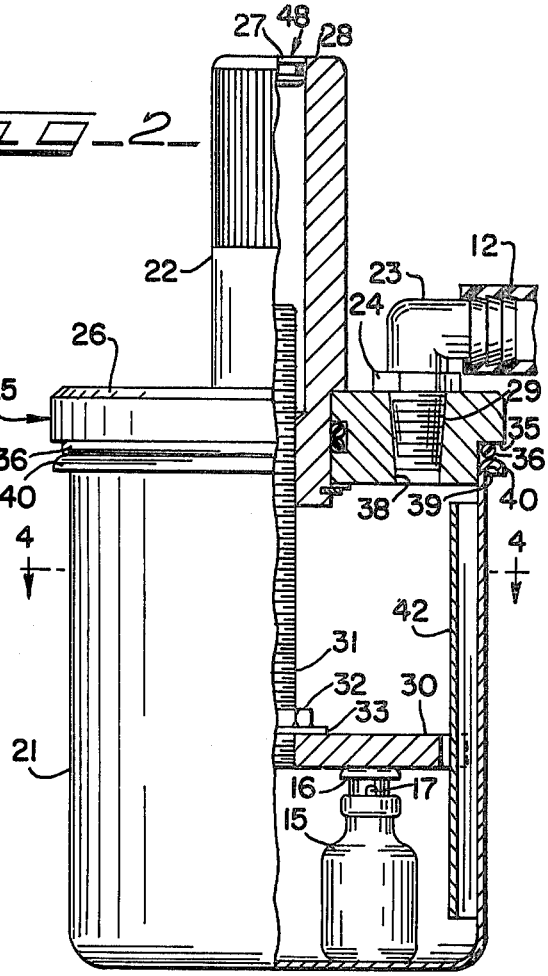
FIG. 2 is a side elevational view partially in cross section to show the stoppering plate stoppering a sample vial.
Figure 3:
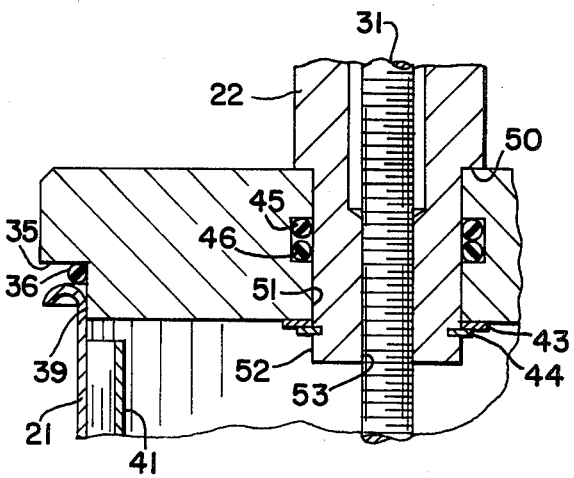
FIG. 3 is a cross-sectional view of a portion of the cover assembly showing it in greater detail; and, FIG. 4 is a cross section taken along the line 4—4 of FIG. 2 of the stoppering container with the cover assembly removed, showing the tracks on which the cover plate rides.
Figure 4:
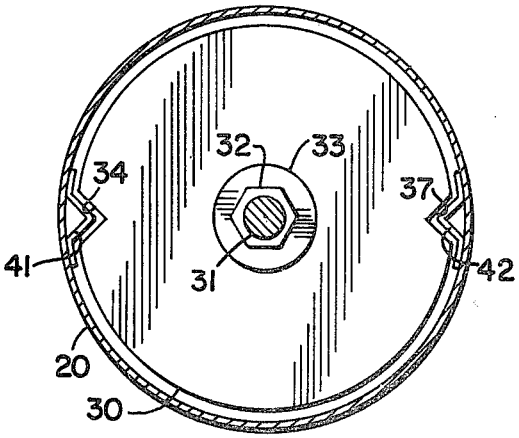

Sample vials, whether for freeze drying or vacuum storage purposes, generally comprise a container 15, as shown in FIG. 2. The container is stoppered by a plug 16, which generally has slots 17 about its periphery so that the plug 16 is loosely mounted in the vial 15, as in FIG. 2, to permit the application of vacuum to the interior of the vial 15. Upon the full closing of the plug 16 in the vial 15, access to the interior of the container is no longer present and, should a vacuum exist within the container 20 prior to stoppering, the plug 16 will effectively retain such vacuum inside the vial 15.

A stoppering plate 30 is loosely mounted within the container 20 for reciprocal action and comprises a generally circular plate of rigid material, such as glass, metal, plastic or the like. Preferably, clear plastic such as polycarbonate or polymethylpentene is used to allow viewing of the sample vials.

In one embodiment of the invention, V-shaped protrusions or tracks 41 and 42 are disposed transverse to the container bottom and diametrically opposite each other on the interior walls of the container 20. On the stoppering plate 30, corresponding V-shaped detents 34 and 37 on the periphery of the stoppering plate 30 and diametrically opposite one another. The detents 34 and 37 are of a size larger than the tracks 41 and 42. Thus, when the stoppering plate 30 is inserted into the container 20, the detents 34 and 37 ride on tracks 41 and 42, respectively, freely and without friction, in addition to allowing vacuum through to the underside of the stoppering plate 30. The tracks 41 and 42 thus serve as guides for the cover plate and also prevent the stoppering plate 30 from rotating with the rotation of the handle to gain positive vertical movement of the plate 30.

The tracks 41 and 42 terminate at a point spaced from the lip 40 of the container body to allow the cover assembly ample room to form a fluid or vapor-tight seal. While the stoppering container of the subject invention is described and shown as having two tracks 41 and 42, which are complementary to detents 34 and 37, it is contemplated, as within the scope of the subject invention, to have more than two tracks and corresponding complementary detents as desired.

The stoppering plate 30 is threadedly secured onto a shaft 31 and locked in a desired place on the shaft by nuts 32 and washer 33, both of stainless steel for easy cleaning and resistance to any corrosive vapors which may be evacuated from a sample vial. The threaded relationship of the handle and shaft is of such a nature as will permit gases to travel from the upper handle portion to the interior of the container and back, dependent on the release or application of vacuum. The mating threads, however, will not slip or strip under any force normally used in stoppering the vials. In this manner, the pressure is equalized throughout the container assembly.

Cover assembly 25 comprises a cover plate 26, which has a reduced lower portion 39 of a diameter slightly less than the inside diameter of the container mouth. The reduced portion 39 of the cover plate 26 creates a shoulder 35 in which a resilient sealing member 36, preferably an O-ring, may be seated. When the cover plate 26 is inserted onto the mouth of the container 20 for closure of the container, the reduced portion is inside the container and the O-ring 36 rests on the lip 40 of the container, being sandwiched between the cover plate 26 and lip 40 to create a fluid-tight seal about the mouth of the container when under vacuum.

As stated above, connection to a vacuum source is made through an elbow fitting 23 which is secured in an opening 38 within the cover plate 26. As is well known in the art, the elbow 23 has a tapered end portion 29 which is serrated to provide a fluid-tight seal and connection to the interior of the container which is difficult to remove except upon the application of a moderate amount of force, thereby assuring an excellent mechanical seal. The addition of a sealing compound or grease can improve the seal of this connection even more.

A central opening in the cover plate 51 accepts a grip or handle 22. While shown as cylindrical in shape with longitudinal grooves providing a gripping surface, any shape or form which may be effectively gripped is contemplated as within the subject invention. The handle 22 is counterbored at its lower end to provide a reduced handle portion 52 and a shoulder 50. The handle 22 is inserted into the opening 51 so that shoulder 50 rests on the surface of the cover plate 26. A ring 43 of metal or other rigid material is fixedly attached to the surface of the lower cover plate portion 39 about the opening 51. A similar ring 44 is fixedly attached about the circumference of the reduced handle portion 52, extending circumferentially outward from the handle. Ring 44 is placed at a point on the lower shaft portion 52 to bias the shoulder 50 lightly against the upper surface of the cover plate 26 while simultaneously contacting the ring 43 in a manner allowing the handle 22 to be rotated without substantial friction.

A seal is effected between the interior and exterior sides of the cover plate 26 through resilient sealing means and, preferably, two O-rings 45 and 46 disposed about the reduced handle portion 52. These O-rings 45 and 46 are located in a channel 47 about the center opening 51 in its mid-section and allow the rotation of the handle 22 while maintaining the cover assembly in a fluid-tight seal on the container body 21. To improve the life of the seal, a silicone grease may be thinly applied to the O-rings prior to insertion in the channel 47.

The handle 22 is hollow, being initially open at opposite ends. The lower reduced portion of the handle 52 is threadedly engaged with the shaft 31 in a manner so that upon rotation of the handle 22 within the opening 51, the shaft 31 and stoppering plate 30, remaining axially stationary, may be moved vertically with discrete movement. As described above, the direction of rotation depends upon the direction of rotation of the handle and the threading of the shaft 31.

The upper end opening 48 of the handle 22 is sealed by a plug 27 which has an O-ring 28 mounted in a peripheral channel. Plug 27 with O-ring 28 is inserted into the opening 48, thereby retaining the fluid-tight seal of the cover assembly 25. The plug 27 is slightly larger than the opening 48 and, when forced into the opening, creates a permanently mounted seal. Again, for a longer effective life of the seal, silicone grease may be thinly applied to the O-ring 28 prior to placement in the channel.

For effective use of the subject invention, one or more sample vials 15 having the stopper partially inserted for communication of the vial interior with the surrounding air, are placed in the container 20 to rest on the container bottom. Preferably, the vials 15 are placed centrally, however, this is not necessary, as explained above. The cover assembly 25 is then placed on the beaker mouth, taking care that the stoppering plate 30 is in a position as will not initially contact the sample vial or its stopper 16. Should it be too low, the position of the stoppering plate 30 may be moved upwardly by the rotation of the handle 22 in the appropriate direction. The cover assembly is placed on the beaker, taking care that O-ring 36 is properly seated about the lip 40 of the container 20.

The entire stoppering assembly 10 is then connected to the appropriate source of vacuum through valve 11 and tubing 12, which is securely mounted on elbow 23. If desired, the assembly 12 may be connected to the vacuum by direct connection between elbow 23 and valve 11. The valve 11 is then adjusted to place the stoppering containers 20 in open communication with the source of vacuum 13, which places the interior of the container under vacuum and withdraws the vapors from the interior of the vial 15 to dry the sample within.

After the appropriate length of time under vacuum, the stoppering plug 16 is slowly and controllably forced into the vial 15 for a fluid-tight seal by the rotation of the handle 22, which drives the shaft and stoppering plate 30 in a downward direction. After the travel of an appropriate distance, the stoppering plate 30 comes into contact with the plug 16. The continued rotation of the handle 22 and downward travel of the stoppering plate 30 drives the plug 16 into the vial 15. The mechanical advantage afforded the movement of the shaft and the stoppering plate by virtue of the threaded relationship of handle and shaft, makes possible the facile stoppering of a plurality of vials. When the vial 15 is fluid-tightly sealed, the stoppering plate 30 will encounter resistance to continued downward movement, which would be of such a nature and magnitude as to give a tactile feedback to the technician rotating the handle 22. Upon sensing such resistance to rotation of the handle 22, the technician is aware that the stoppering of the vials has been accomplished and, therefore, the vacuum in the container is released by proper manipulation of valve 11 and the pressure restored to ambient. The cover assembly 25 may then be easily lifted off the container lip 40 and the sample vial withdrawn and stored, or the dried sample may be utilized in another appropriate manner.

It is possible in the use of the subject inventive stoppering container to place a second layer of sample vials on the top of the stoppering plate 30 to double the number of possible vials under vacuum at a given time. With such double capacity, the stoppering plate would first be drawn upward to stopper the upper layer of vials by forcing them against the cover plate 26, with rotation of the handle in one direction and then reversing the direction of rotation of the handle to lower the stoppering plate and force the stoppering plugs 16 into the lower level of vials 15.

Upon a consideration of the foregoing, it will become obvious to those skilled in the art that various modifications may be made without departing from the invention embodied herein. Therefore, only such limitations should be imposed as are indicated by the spirit and scope of the appended claims.

I claim:

1. A stoppering container for the stoppering of sample vials under vacuum comprising a cover assembly, a stoppering plate and a container body, said cover assembly including a cover plate having an opening therein, a handle rotatably secured in said opening, a shaft, said shaft being fixedly attached at a lower end to said stoppering plate and threadedly attached on an upper portion to said rotatable handle, said container body having means for guiding said stoppering plate for vertical movement in a substantially fixed circumferential orientation, whereby upon rotation of said handle, said shaft and said stoppering plate may be controllably vertically moved within said container body to force stoppering plugs into sample vials.

2. The stoppering assembly of claim 1 wherein the fluid-tight seal of said cover assembly is retained while the handle is rotated as a result of a resilient sealing means seated in an interior channel about the central opening of said cover plate and disposed about the periphery of said handle.

3. The stoppering assembly of claim 2 wherein said resilient sealing means comprises at least two O-rings.

4. The stoppering assembly of claim 1 wherein said means for guiding comprise at least two V-shaped extensions on the interior side wall of said container body.

5. The stoppering assembly of claim 4 wherein the periphery of said stoppering plate has at least two V-shaped indentations, said indentations being complementary to said V-shaped extensions on the interior wall of said container body.

6. The stoppering assembly of claim 5 wherein said V-shaped indentations on said stoppering plate are spaced a sufficient amount from said V-shaped extensions to allow free movement of said stoppering plate within said container body while retaining the capability to guide said stoppering plate.

7. The stoppering assembly of claim 1 wherein said means for guiding are spaced from the upper end of the container body to allow a fluid-tight seal to be made at said upper end by said cover assembly.

8. The stoppering assembly of claim 1 wherein said handle is initially a substantially hollow cylinder, said cylinder being closed in a fluid-tight manner at an upper end thereby by a tightly fitting plug, said tightly fitting plug having a peripheral channel and an O-ring seated in said peripheral channel, said O-ring fluid-tightly sealing said upper end of said handle when said plug is secured within said upper end opening.

9. A vacuum container assembly for use in the application of vacuum to a sample vial within said container assembly, said vacuum container assembly comprising a cover assembly fluid-tightly mounted on a container body, said cover assembly including a cover plate having a central opening, a port in said cover plate for the application of vacuum, a hollow grip means rotatably and fluid-tightly mounted through said opening in a plane transverse to said cover plate, a shaft having a driving means on a lower end thereof, said grip means being threadedly engaged with said shaft for the controlled movement of said shaft and driving means toward and away from said sample vial, the movement of said driving means being guided within said container body by guide means, said guide means including channels in said driving means cooperating with ribs in said container body, whereby said guide means prevent the rotation of said driving means during the movement of said driving means.

* * * * *